US008468679B2

(12) United States Patent
Cackett et al.

(10) Patent No.: US 8,468,679 B2
(45) Date of Patent: Jun. 25, 2013

(54) METHOD OF MANUFACTURE TO CONTROL SCORELINE PROFILE

(75) Inventors: Matthew T. Cackett, San Diego, CA (US); Wayne H. Byrne, Murrieta, CA (US); Alan Hocknell, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 346 days.

(21) Appl. No.: 12/908,711

(22) Filed: Oct. 20, 2010

(65) Prior Publication Data

US 2011/0094086 A1 Apr. 28, 2011

Related U.S. Application Data

(60) Provisional application No. 61/254,581, filed on Oct. 23, 2009.

(51) Int. Cl.
*B23P 13/04* (2006.01)
*A63B 53/00* (2006.01)

(52) U.S. Cl.
USPC ..... 29/557; 29/527.4; 473/331

(58) Field of Classification Search
USPC ..... 29/527.4, 557; 473/331
See application file for complete search history.

(56) References Cited

U.S. PATENT DOCUMENTS

| | | | | |
|---|---|---|---|---|
| 5,704,849 | A | 1/1998 | Schmidt et al. | |
| 5,749,795 | A | 5/1998 | Schmidt et al. | |
| 5,776,010 | A | 7/1998 | Helmstetter et al. | |
| 5,921,869 | A | 7/1999 | Blough et al. | |
| 5,971,868 | A | 10/1999 | Kosmatka | |
| 6,045,455 | A | 4/2000 | Kosmatka et al. | |
| 6,186,905 | B1 | 2/2001 | Kosmatka | |
| 6,210,290 | B1 | 4/2001 | Erickson et al. | |
| 7,083,531 | B2 | 8/2006 | Aguinaldo et al. | |
| 7,090,591 | B2 * | 8/2006 | Sano | 473/324 |
| 7,112,148 | B2 | 9/2006 | Deshmukh | |
| 7,144,336 | B2 | 12/2006 | Reyes et al. | |
| 7,326,126 | B2 | 2/2008 | Holt et al. | |
| 7,338,387 | B2 | 3/2008 | Nycum et al. | |
| 7,338,389 | B2 | 3/2008 | Wieland et al. | |
| 8,140,021 | B2 * | 3/2012 | Aiba et al. | 455/67.11 |
| 2009/0029797 | A1 * | 1/2009 | Ban et al. | 473/331 |

* cited by examiner

*Primary Examiner* — Alexander P Taousakis
(74) *Attorney, Agent, or Firm* — Michael A. Catania; Rebecca Hanovice; Sonia Lari

(57) ABSTRACT

A manufacturing method for iron-type golf club heads wherein the scorelines of the iron-type golf club heads are media blasted and partially filled with clear paint to adjust the profile to a desired configuration that satisfies the 2010 condition of competition for golf clubs as set forth by the ruling bodies of golf.

3 Claims, 9 Drawing Sheets

Modified Scoreline Profile

Original Scoreline Profile

Modified Scoreline Profile

Comparison Of Profiles
——— Original
------- Modified

Basline Measurement (Center)

| Groove # | Width | Depth | Area | Separation | Lower Edge Deviation | Lower Edge Angle | Upper Edge Deviation | Upper Edge Angle | Minimum Separation | Separation Less 3x Max | Area/Pitch |
|---|---|---|---|---|---|---|---|---|---|---|---|
| 1 | 0.031447 | 0.01757 | 0.000398 | 0.10246 | 0.011058 | 0 | 0.011316 | 17.098 | 0.10246 | 0.00624 | 0.0029725 |
| 2 | 0.032072 | 0.017785 | 0.000417 | 0.10292 | 0.011019 | 0 | 0.011302 | 13.18 | 0.10246 | 0.006267 | 0.0030998 |
| 3 | 0.032216 | 0.018143 | 0.000419 | 0.10304 | 0.011307 | 14.396 | 0.011272 | 14.966 | 0.10292 | 0.005478 | 0.0031061 |
| 4 | 0.032521 | 0.018603 | 0.000455 | 0.10145 | 0.011236 | 11.128 | 0.011144 | 0 | 0.10145 | 0.003452 | 0.0033982 |
| 5 | 0.032665 | 0.018134 | 0.000423 | 0.10314 | 0.011204 | 10.588 | 0.011203 | 12.888 | 0.10145 | 0.005139 | 0.0031549 |
| 6 | 0.032033 | 0.018335 | 0.000433 | 0.10419 | 0.011422 | 15.793 | 0.011277 | 0 | 0.10314 | 0.008095 | 0.0032091 |
| 7 | 0.032033 | 0.018214 | 0.000423 | 0.10231 | 0.011442 | 15.612 | 0.011229 | 12.989 | 0.10231 | 0.00342 | 0.0031558 |
| 8 | 0.032962 | 0.01266 | 0.000292 | 0.1018 | 0.010939 | 0 | 0.010831 | 0 | 0.1018 | 0.002917 | 0.002168 |
| 9 | 0.032029 | 0.012769 | 0.000292 | 0 | 0.010865 | 0 | 0.010632 | 0 | 0.1018 | 0 | 0.0021844 |
| Average | | | | | 0.0112 | | 0.0111 | | | | 0.0029 |

*FIG. 11*

After media blasting process (center)

| Groove # | Width | Depth | Area | Separation | Lower Edge Deviation | Lower Edge Angle | Upper Edge Deviation | Upper Edge Angle | Minimum Separation | Separation Less 3x Max | Area/Pitch |
|---|---|---|---|---|---|---|---|---|---|---|---|
| 1 | 0.031564 | 0.018053 | 0.000426 | 0.10457 | 0.010294 | 0 | 0.010888 | 0 | 0.10457 | 0.009877 | 0.0031297 |
| 2 | 0.030936 | 0.018263 | 0.00043 | 0.10127 | 0.010589 | 0 | 0.010543 | 0 | 0.10127 | 0.005611 | 0.0032525 |
| 3 | 0.031886 | 0.018132 | 0.00042 | 0.10251 | 0.010292 | 0 | 0.010622 | 0 | 0.10127 | 0.005452 | 0.0031577 |
| 4 | 0.032353 | 0.018338 | 0.000432 | 0.10142 | 0.010277 | 0 | 0.011013 | 0 | 0.10142 | 0.004355 | 0.0032313 |
| 5 | 0.032345 | 0.018204 | 0.000423 | 0.10173 | 0.010178 | 0 | 0.011205 | 0 | 0.10142 | 0.004692 | 0.0031646 |
| 6 | 0.032189 | 0.018415 | 0.000435 | 0.1025 | 0.010339 | 0 | 0.011188 | 11.993 | 0.10173 | 0.005017 | 0.0032518 |
| 7 | 0.032495 | 0.018337 | 0.000438 | 0.10015 | 0.010289 | 0 | 0.010733 | 0 | 0.10015 | 0.002661 | 0.0033023 |
| 8 | 0.032033 | 0.012361 | 0.000311 | 0.10121 | 0.010288 | 0 | 0.010693 | 0 | 0.10015 | 0.002797 | 0.0023604 |
| 9 | 0.032806 | 0.013099 | 0.00033 | 0 | 0.010334 | 0 | 0.010724 | 0 | 0.10121 | 0 | 0.0024643 |
| Average | | | | | 0.0103 | | 0.0108 | | | | 0.0030 |

*FIG. 13*

After media blast and clear coat in grooves (center)

| Groove # | Width | Depth | Area | Separation | Lower Edge Deviation | Lower Edge Angle | Upper Edge Deviation | Upper Edge Angle | Minimum Separation | Separation Less 3x Max | Area/Pitch |
|---|---|---|---|---|---|---|---|---|---|---|---|
| 1 | 0.031439 | 0.012351 | 0.00027 | 0.10338 | 0.010432 | 0 | 0.01034 | 0 | 0.10338 | 0.009063 | 0.0020032 |
| 2 | 0.030495 | 0.012027 | 0.000268 | 0.10321 | 0.0105 | 0 | 0.010342 | 0 | 0.10321 | 0.009856 | 0.0020059 |
| 3 | 0.031117 | 0.013726 | 0.00031 | 0.1024 | 0.010581 | 0 | 0.010456 | 0 | 0.1024 | 0.00578 | 0.0023278 |
| 4 | 0.032205 | 0.014954 | 0.000338 | 0.10001 | 0.010598 | 0 | 0.010343 | 0 | 0.10001 | 0.003399 | 0.0025629 |
| 5 | 0.032191 | 0.014475 | 0.000324 | 0.10092 | 0.010667 | 0 | 0.01026 | 0 | 0.10001 | 0.004348 | 0.0024516 |
| 6 | 0.031074 | 0.014094 | 0.000319 | 0.10278 | 0.010828 | 0 | 0.010254 | 0 | 0.10092 | 0.006717 | 0.0024232 |
| 7 | 0.03202 | 0.014133 | 0.000317 | 0.10211 | 0.010681 | 0 | 0.0102 | 0 | 0.10211 | 0.006054 | 0.0023683 |
| 8 | 0.028878 | 0.008078 | 0.000175 | 0 | 0.010368 | 0 | 0.010192 | 0 | 0.10211 | 0 | 0.0013427 |
| Average | | | | | 0.0106 | | 0.0103 | | | | 0.0022 |

*FIG. 15*

METHOD OF MANUFACTURE TO CONTROL SCORELINE PROFILE

CROSS REFERENCES TO RELATED APPLICATIONS

The present application claims priority to U.S. Provisional Patent Application No. 61/254581, filed on Oct. 23, 2010, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head manufacturing. More specifically, the present invention relates to a method of manufacturing to control a scoreline profile of a golf club head.

2. Description of the Related Art

Irons are typically composed of a stainless steel or titanium material, and are typically cast or forged. Scorelines (aka grooves) on the striking face of golf club heads such as irons, wedges, hybrids and fairway woods are typically made with a "U" or "V" cross-section shape. Current scoreline designs may have relatively sharp edges and a relatively large cross-section area as allowed by the current rules of golf. However, starting in 2010 a condition of competition requirement will be implemented for clubs used on the used on the professional tours. In 2024 this condition will be implemented for all clubs used by amateurs and professionals alike.

Existing clubs that do not satisfy the condition of competition, which requires less sharp edges and less cross-section area, are thus rendered unusable and essentially worthless. This invention seeks to define a method by which clubs which would otherwise not satisfy the 2010 condition of competition can be reworked such that they are transformed in a geometric condition that does satisfy the 2010 condition of competition.

BRIEF SUMMARY OF THE INVENTION

The purpose of this invention is to provide a method manufacture that transforms existing scorelines from a state that does not satisfy the 2010 condition of competition into a state that does.

Difficulties to be overcome include the impracticality of using the same manufacturing method as originally used to fabricate the scorelines. For instance, cast scorelines cannot readily be recast; engraved scorelines cannot readily be re-engraved, particularly if material must be added; pressed or forged scorelines cannot readily be re-pressed due to fixturing complexities. Each of these methods is even less practical if the head has been assembled into a club.

In the case of scoreline edges that are too sharp, the edges must be modified in some manner to increase the edge radius to some minimum value corresponding to the side wall angle of the scoreline. Modification of the edge in this manner requires removal of material which can be challenging for a range of materials such as stainless steel, carbon steel, titanium and maraging steel.

In the case of scoreline cross-section area being too large for the corresponding scoreline spacing (Area to pitch, A/P) the scoreline must be modified in a manner that reduces the area, since the spacing cannot be revised in any practical manner. Modification of the scoreline in this manner requires that material be added to the scoreline which cannot be done by any of the original methods of manufacture.

An important aspect of this invention is that the degree of modification to the edges and cross-section area can be controlled by process control and/or by iteration. On the other hand, a method that is not controllable may result in scorelines that satisfy the 2010 condition of competition but that are ineffective in generating ball spin due to the edge being overly softened or the cross-section area being overly reduced.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 11 is a table of baseline center measurements.

FIG. 13 is a table of after-media blasting center measurements.

FIG. 15 is a table of after media and clear coat fill center measurements.

DETAILED DESCRIPTION OF THE INVENTION

Figure 1:
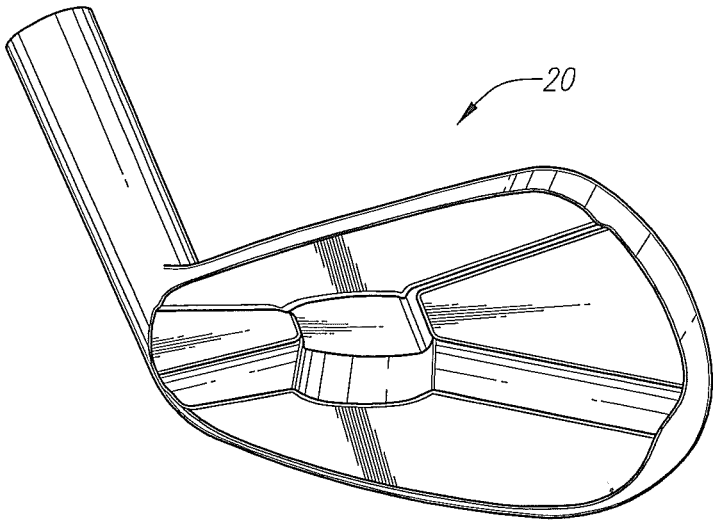
FIG. 1 is a back view of an iron-type golf club head.
Figure 2:
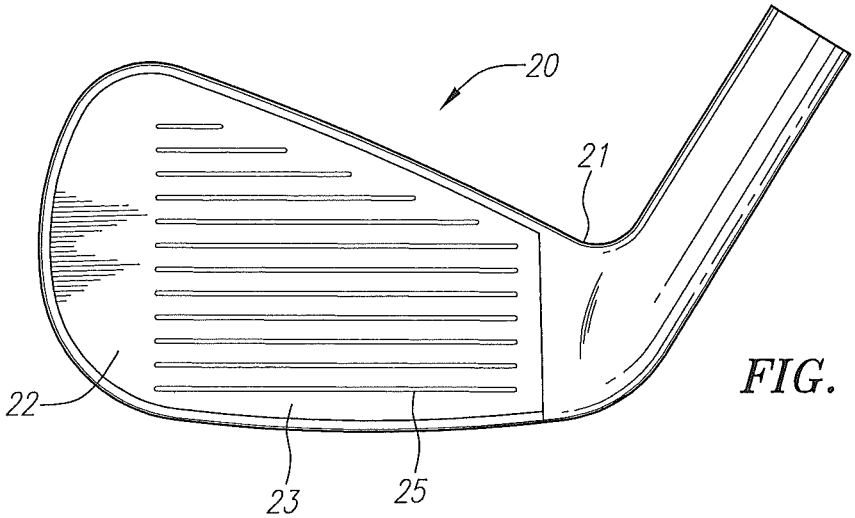
FIG. 2 is a front elevational view of an iron-type golf club head.
Figure 3:
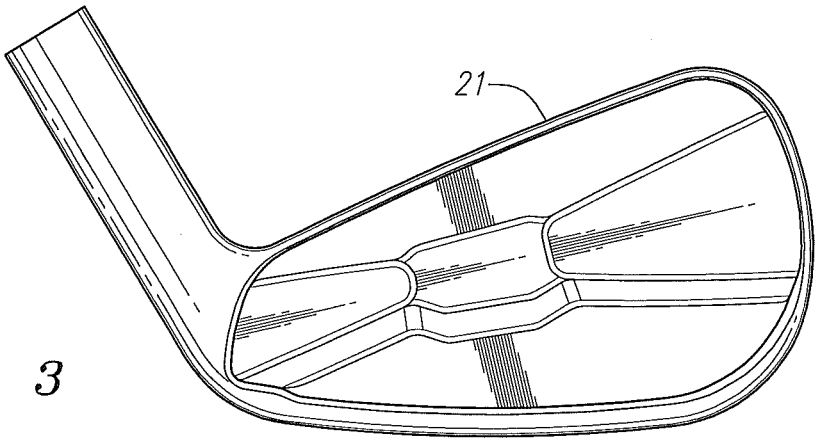
FIG. 3 is a rear elevational view of an iron-type golf club head.
Figure 4:
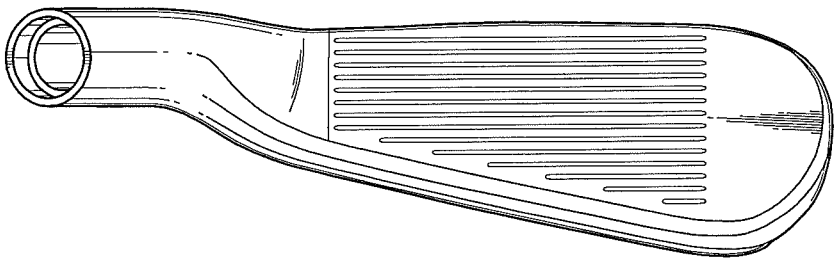
FIG. 4 is a top view of an iron-type golf club head.
Figure 5:
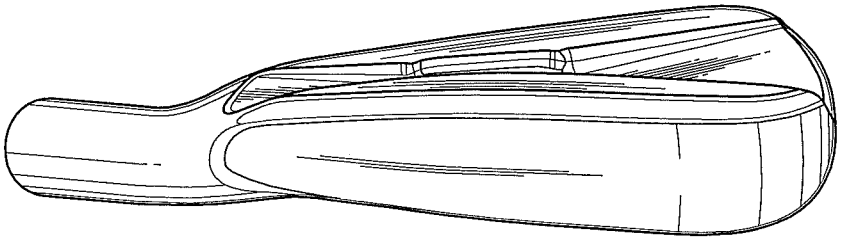
FIG. 5 is a bottom plan view of an iron-type golf club head.
Figure 6:
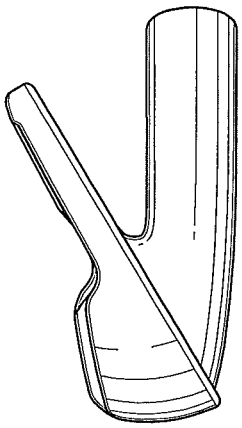
FIG. 6 is a toe side view of an iron-type golf club head.
Figure 7:
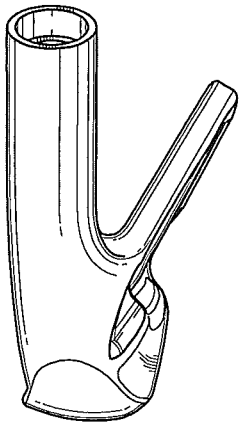
FIG. 7 is heel side view of an iron-type golf club head.
Figure 8:
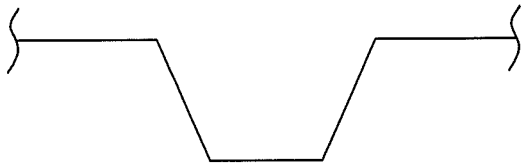
FIG. 8 is a cross-sectional view of an original scoreline profile.
Figure 9:
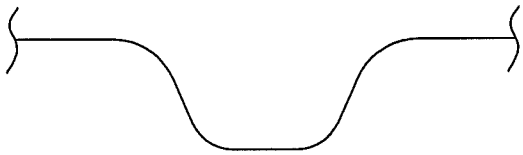
FIG. 9 is a cross-sectional view of a modified scoreline profile.
Figure 10:
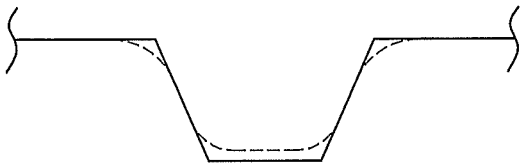
FIG. 10 is a cross-sectional view of a comparison of scoreline profiles.
Figure 12:
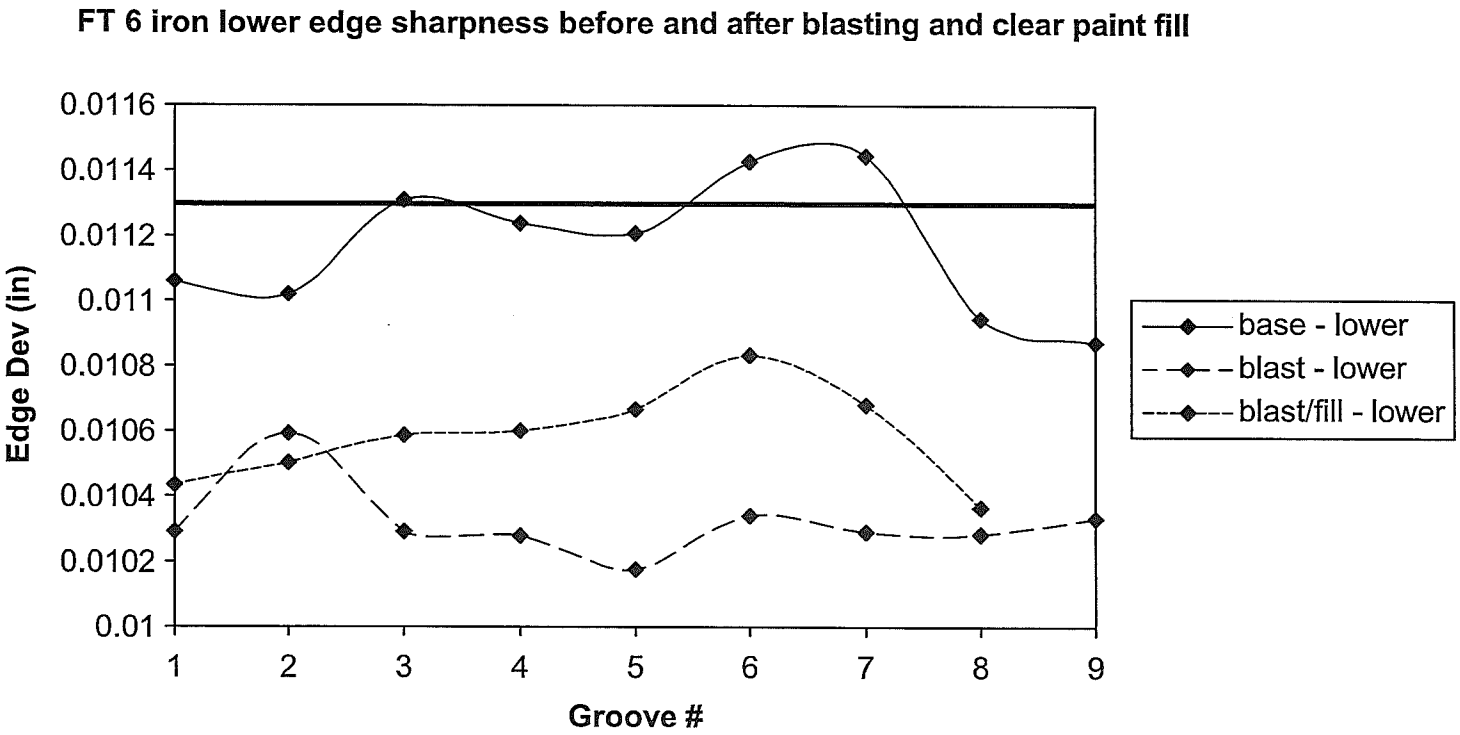
FIG. 12 is a graph of edge versus groove.
Figure 14:
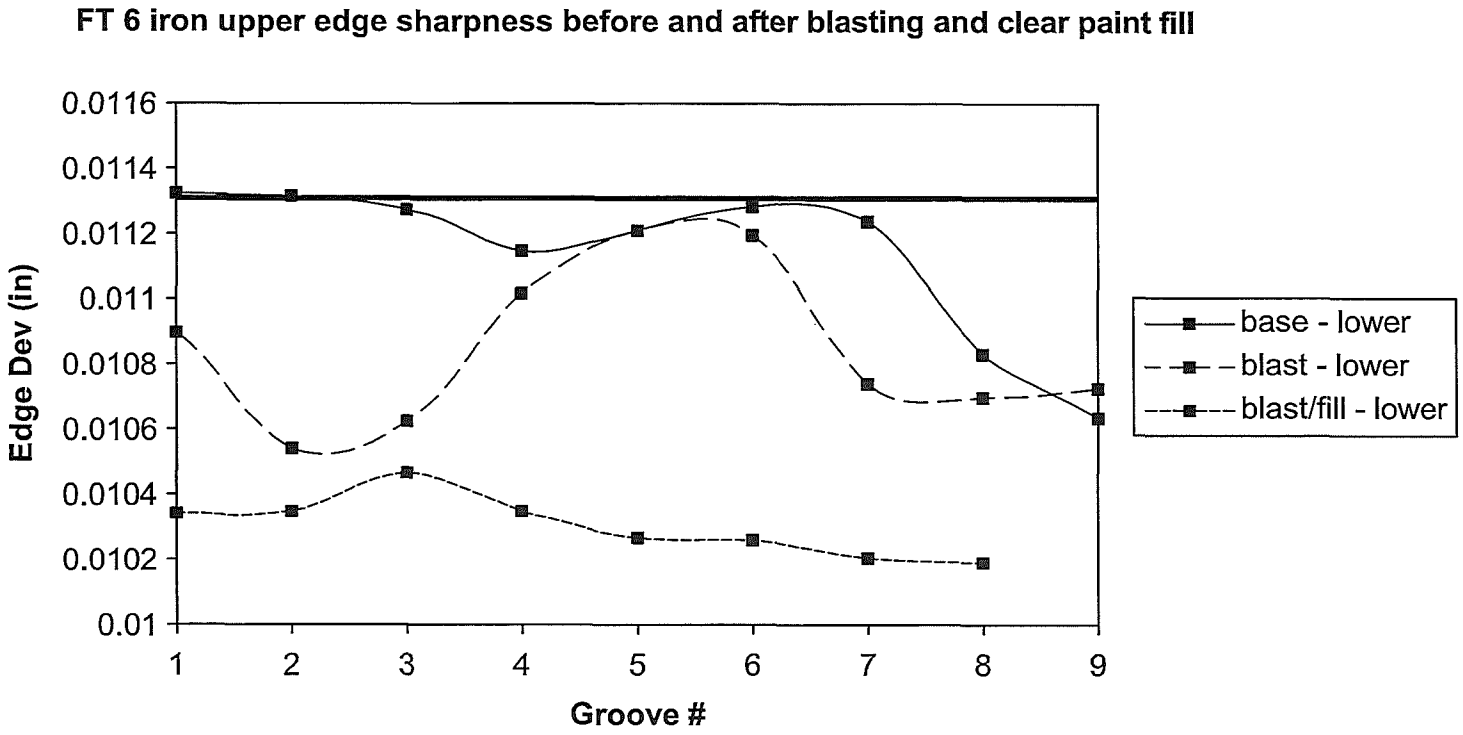
FIG. 14 is a graph of edge versus groove.
Figure 16:
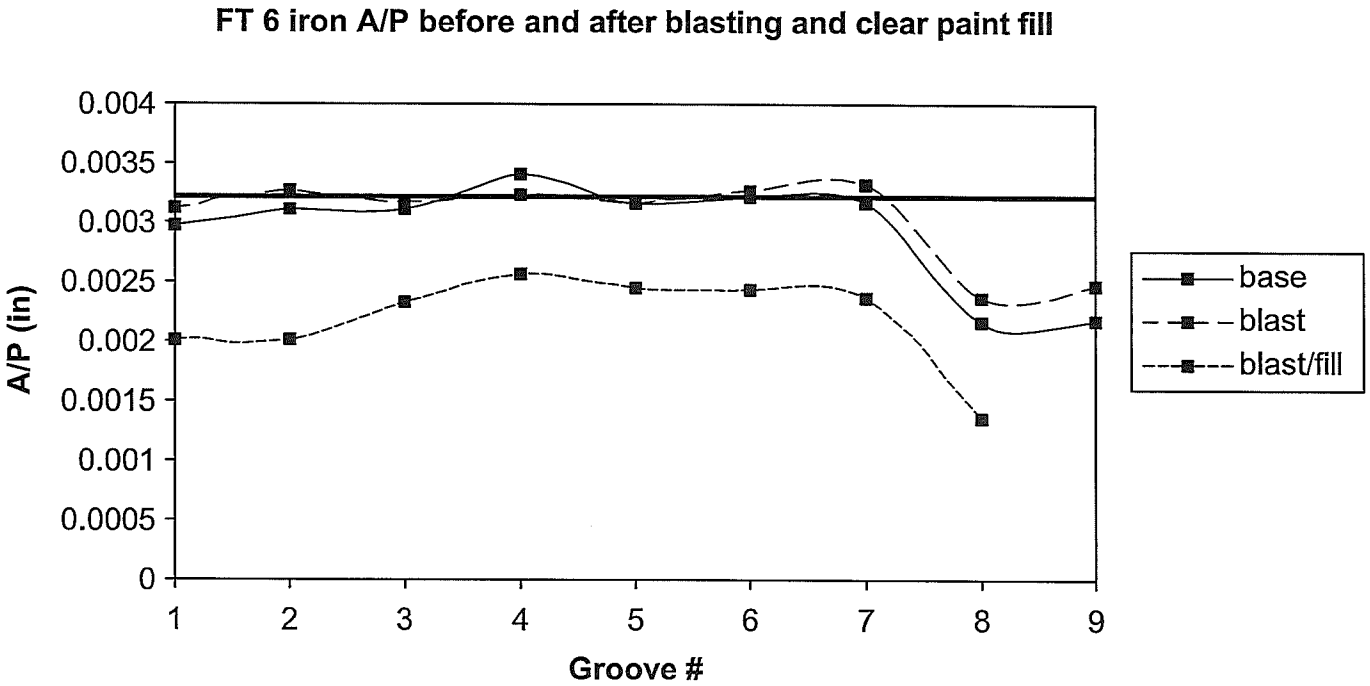
FIG. 16 is a graph of edge versus groove.

As shown in the figures, an iron-type golf club is generally designated 20. The golf club head 20 includes a body 21 having a face 22 with a surface 23 and a plurality of grooves 25. The body 21 is preferably composed of a material such as titanium materials, stainless steel, carpenter steel, 1020 steel, amorphous metals and the like. The material of the body 21 preferably has a density between 4 g/cm$^3$ and 10 g/cm$^3$. Such titanium materials include pure titanium and titanium alloys such as 6-4 titanium alloy, 6-22-22 titanium alloy, 4-2 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. The body 21 is preferably manufactured through casting. Alternatively, the body 21 is manufactured through forging, forming, machining, powdered metal forming, metal-injection-molding, electro-chemical milling, and the like.

In general, the moment of inertia, Izz, about the Z-axis for the golf club head 20 preferably ranges from 2200 g-cm$^2$ to 3000 g-cm$^2$, more preferably from 2400 g-cm$^2$ to 2700 g-cm$^2$, and most preferably from 2472 g-cm$^2$ to 2617 g-cm$^2$. The moment of inertia, Iyy, about the Y-axis for the golf club head 20 preferably ranges from 400 g-cm$^2$ to 700 g-cm$^2$, more preferably from 500 g-cm$^2$ to 600 g-cm$^2$, and most preferably from 530 g-cm$^2$ to 560 g-cm$^2$. The moment of inertia, Ixx, about the X-axis for the golf club head 20 preferably ranges from 2450 g-cm$^2$ to 3200 g-cm$^2$, more preferably from 2500 g-cm$^2$ to 2900 g-cm$^2$, and most preferably from 2650 g-cm$^2$ to 2870 g-cm$^2$.

Alternatively, the structure of the iron-type golf club is such as disclosed in Helmstetter, et al., U.S. Pat. No. 5,776,010, which is hereby incorporated by reference in its entirety.

Alternatively, the structure of the iron-type golf club is such as disclosed in Schmidt, et al., U.S. Pat. No. 5,749,795, which is hereby incorporated by reference in its entirety.

Alternatively, the structure of the iron-type golf club is such as disclosed in Schmidt, et al., U.S. Pat. No. 5,704,849, which is hereby incorporated by reference in its entirety Alternatively, the structure of the iron-type golf club is such as disclosed in Blough et al., U.S. Pat. No. 5,921,869, which is hereby incorporated by reference in its entirety.

Alternatively, the structure of the iron-type golf club is such as disclosed in Kosmatka, U.S. Pat. No. 5,971,868, which is hereby incorporated by reference in its entirety.

Alternatively, the structure of the iron-type golf club is such as disclosed in Kosmatka, U.S. Pat. No. 6,045,455, which is hereby incorporated by reference in its entirety.

Alternatively, the structure of the iron-type golf club is such as disclosed in Kosmatka, U.S. Pat. No. 6,186,905, which is hereby incorporated by reference in its entirety.

Alternatively, the structure of the iron-type golf club is such as disclosed in Erickson, et al., U.S. Pat. No. 6,210,290, which is hereby incorporated by reference in its entirety.

Alternatively, the structure of the iron-type golf club is such as disclosed in Reyes, et al., U.S. Pat. No. 7,144,336, which is hereby incorporated by reference in its entirety.

Alternatively, the structure of the iron-type golf club is such as disclosed in Deshmukh, U.S. Pat. No. 7,112,148, which is hereby incorporated by reference in its entirety.

Alternatively, the structure of the iron-type golf club is such as disclosed in Aguinaldo, et al., U.S. Pat. No. 7,083,531, which is hereby incorporated by reference in its entirety.

Alternatively, the structure of the iron-type golf club is such as disclosed in Wieland, et al., U.S. Pat. No. 7,338,389, which is hereby incorporated by reference in its entirety.

Alternatively, the structure of the iron-type golf club is such as disclosed in Nycum, et al., U.S. Pat. No. 7,338,387, which is hereby incorporated by reference in its entirety.

Alternatively, the structure of the iron-type golf club is such as disclosed in Holt, et al., U.S. Pat. No. 7,326,126, which is hereby incorporated by reference in its entirety.

The following method has been invented to transform scorelines from a condition that does not satisfy the 2010 condition of competition into a condition that does. The process may start with an existing iron, wedge or even hybrid or fairway wood in the form of a finished head or club or may be incorporated at the end of the standard manufacturing process.

First, abrade the surface of the club face in the region of the scorelines using a media blasting method. A preferred media would be #20 cut wire stainless steel shot peen media. The orientation of media blasting is preferentially normal to the face. Time and pressure of blasting is adjusted to be commensurate with the amount of material to be removed from the edges. (this portion of the method is used to affect edge sharpness).

Next , apply a clear paint fill to the scorelines. A preferred paint fill would be a 2-part satin urethane paint. The paint is cured at room temperature or elevated temperature. The amount of paint applied to the scorelines is adjusted to be commensurate with the reduction in cross-section area to be achieved. Preferrably, the paint is only applied to the scorelines and not to the face area between the scorelines so as not to affect the friction of the area between scorelines.

The result is edge sharpness may be reduced from 0.000R to 0.010R (larger radius indicates less sharpness). In terminology used by the USGA, the "edge deviation" as defined by the "2 circles method" may be reduced from 0.0130" to 0.0104" or less.

Further, the scoreline cross-section area may be reduced by up to 40% with a similar reduction in the A/P parameter.

Also, scorelines that are evaluated as not satisfying the condition of competition may be modified so they do satisfy the condition of competition.

Thus, the method of manufacture is readily adapted to use in the field, for instance by club manufacturer representatives at tour trailers that are on-site at professional golf tournaments. Further, the method may be used iteratively to achieve a fairly specific edge sharpness or cross-section area.

The result is scorelines fabricated or modified using a manufacturing method wherein the scorelines are media blasted and partially filled with clear paint to adjust the profile to a desired configuration that satisfies the 2010 condition of competition for golf clubs.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A method for manufacturing an iron-type golf club head, the method comprising:

forming an iron-type golf club head body, the iron-type golf club head body having a striking plate with an exterior surface;

machining a plurality of grooves into the exterior surface of the striking plate to create a machined striking plate;

sandblasting the exterior surface of the machined striking plate to create a sandblasted striking plate;

applying a coating in only each of the plurality of grooves of the sandblasted striking plate to create a coating-filled groove striking plate, each of the plurality of grooves of the coating-filled groove striking plate having a volume less than the volume of each of the plurality of grooves of the machined striking plate;

wherein an edge deviation of each of the plurality of grooves is reduced from 0.0130 inch to 0.0104 or less after applying the coating.

2. A method for manufacturing an iron-type golf club head, the method comprising:

machining a plurality of grooves into the exterior surface of the striking plate to create a machined striking plate;

blasting the exterior surface of the machined striking plate to create a sandblasted striking plate;

applying a coating in only each of the plurality of grooves of the blasted striking plate to create a coating-filled groove striking plate, each of the plurality of grooves of the coating-filled groove striking plate having a volume less than the volume of each of the plurality of grooves of the machined striking plate;

wherein an edge deviation of each of the plurality of grooves is reduced from 0.0130 inch to 0.0104 or less after applying the coating.

3. A method for manufacturing an iron-type golf club head, the method comprising:

abrading a surface of a golf club head using a media blast; and applying a clear coat to a plurality of grooves in the surface of the golf club head;

wherein applying a clear coat to a plurality of grooves in the surface of the golf club head comprises applying a coating in only each of the plurality of grooves to create a coating-filled striking plate, each of the plurality of grooves of the coating-filled striking plate having a volume less than the volume of each of the plurality of grooves of the striking plate and wherein an edge deviation of each of the plurality of grooves is reduced from 0.0130 inch to 0.0104 or less after applying the coating.

* * * * *